US005409519A

United States Patent [19]

Seki et al.

[11] Patent Number: 5,409,519

[45] Date of Patent: Apr. 25, 1995

[54] CONTACT MATERIAL FOR VACUUM VALVE

[75] Inventors: Tsuneyo Seki, Tokyo; Tsutomu Okutomi, Kanagawa; Atsushi Yamamoto, Tokyo, all of Japan

[73] Assignee: Kabushiki Kaisha Toshiba, Kawasaki, Japan

[21] Appl. No.: 69,104

[22] Filed: May 28, 1993

[30] Foreign Application Priority Data

Feb. 5, 1993 [JP] Japan ..... 5-018270

[51] Int. Cl.[6] ..... C22C 9/00; C22C 30/02

[52] U.S. Cl. ..... 75/245; 75/247; 200/262; 200/264; 252/514; 252/520

[58] Field of Search ..... 75/245, 247; 252/514, 252/520; 200/262, 264

[56] References Cited

U.S. PATENT DOCUMENTS 4,486,631 12/1984 Naya et al. ..... 200/144 B
4,777,335 10/1988 Okutomi et al. ..... 200/264
4,830,821 5/1989 Okutomi et al. ..... 419/25
5,045,281 9/1991 Okutomi et al. ..... 420/497

FOREIGN PATENT DOCUMENTS 59-201334 11/1984 Japan .
59-201335 11/1984 Japan .

*Primary Examiner*—Ngoclan T. Mai
*Attorney, Agent, or Firm*—Oblon, Spivak, McClelland, Maier & Neustadt

[57] ABSTRACT

A contacts material for a vacuum valve including an arc-proof constituent having at least one component selected from the group consisting of tantalum, niobium, tungsten and molybdenum and an auxiliary constituent having at least one component selected from the group consisting of chromium, titanium, yttrium, zirconium, cobalt and vanadium. The contact material further includes a conductive constituent having at least one component selected from the group consisting of copper and silver. The amount of the arc-proof constituent is from 25% to 75% by volume. The total amount of the arc-proof constituent together with the auxiliary constituent is no more than 75% by volume. The amount of the conductive constituent is the balance.

5 Claims, 1 Drawing Sheet

CONTACT MATERIAL FOR VACUUM VALVE

BACKGROUND OF THE INVENTION

1. Field of the Invention

This invention relates to a contact material for a vacuum valve and a method of manufacturing the same.

2. Description of the Related Art

The most important properties which contact material for vacuum valves is required to have are the three basic requirements of anti-welding property, voltage withstanding capability and current interrupting property. Further important requirements are to show low and stable rise in temperature and low and stable contact resistance. However, it is not possible to satisfy all these requirements by a single metal, as some of them are contradictory. Consequently, many of the contact materials that have been developed for practical use consist of combinations of two or more elements so as to complement their mutual deficiencies in performance, and to match specific applications such as large-current use or high voltage-withstanding ability. However, performance requirements have become increasingly severe and the present situation is such that these materials are unsatisfactory in some respects. A marked recent tendency is towards expansion of the use of these materials to capacitor circuits. Corresponding development and improvement of contact materials is an urgent task.

In order to cope with this, contact materials have previously been employed consisting of copper, as conductive constituent, combined with tungsten, molybdenum, tantalum or niobium, which are high melting point materials and in general provide excellent withstand-voltage capability.

Such Cu-W or the like contact materials can be applied in fields where a certain degree of withstand-voltage performance is required. However, they are subject to the problem of restriking in more severe high withstand-voltage regions and circuits in which inrush currents occur. The reason for this is insufficient adhesive strength between the grains of the arc-proof material and the conductive constituent, owing to insufficient wetting of the arc-proof material by the conductive constituent.

Specifically, restriking occurs, even though the electrodes are in open condition, because particles of arc-proof material get electrically charged and are discharged from the surface of the contacts, and because gas is emitted from pores produced in the interior of the contacts by insufficient wetting. Furthermore, when local welding takes place due to radio frequency currents etc. generated when the circuit is closed, since the interface between the aforementioned arc-proof material and conductive constituent is weak and local pores are present, transfer to the contact surface occurs when the electrodes are separated. This causes electric field concentrations etc., which may result in restriking. Such restriking may cause malfunctioning of the circuit system, resulting for example in cut-off of power. In particular, in capacitor circuits, a voltage of twice the ordinary circuit voltage is applied, so the problem of the withstand-voltage characteristic of the contacts, in particular, suppression of restriking has become prominent.

As described above, the reason for occurrence of restriking is insufficient strength of adhesion between the grains of arc-proof material and the conductive constituent, due to insufficient wetting of the arc-proof material with the conductive constituent. It is therefore vital to reduce the frequency of occurrence of restriking by increasing the interface strength and reducing internal pores.

SUMMARY OF THE INVENTION

Accordingly, one object of this invention is to provide a contact material for a vacuum valve, whereby the frequency of occurrence of restriking is reduced.

Another object of this invention is to provide a method of manufacturing a contact material for a vacuum valve, whereby the frequency of occurrence of restriking is reduced.

In order to achieve the aforementioned object, the essence of this invention consists in the addition to the arc-proof constituent and conductive constituent of the auxiliary constituent consisting of at least one of chromium, titanium, yttrium, zirconium, cobalt, and vanadium, in order to strengthen adhesion of the arc-proof constituent and conductive constituent.

These and other objects of this invention can be achieved by providing a contacts material for vacuum valve including an arc-proof constituent having at least one component selected from the group consisting of tantalum, niobium, tungusten and molybdenum and an auxiliary constituent having at least one component selected from the group consisting of chromium, titanium, yttrium, zirconium, cobalt and vanadium. The contact material further includes a conductive constituent having at least one component selected from the group consisting of copper and silver. An amount of the arc-proof constituent is from 25% to 75% by volume. A total amount of the arc-proof constituent together with the auxiliary constituent is no more than 75% by volume. In addition, an amount of the conductive constituent comprises the balance.

These and other objects of this invention can further be achieved by providing a method of manufacturing the contacts material as described above including the step of manufacturing a skeleton with the arc-proof constituent and the auxiliary constituent. The method further includes the step of infiltrating the skeleton with an infiltration material to obtain the contact material.

These and other objects of this invention can further be achieved by providing a method of manufacturing the contacts material as described above including the step of manufacturing a skeleton with the arc-proof constituent, the auxiliary constituent and the conductive constituent. The method further includes the step of infiltrating the skeleton with an infiltration material to obtain the contacts material.

These and other objects of this invention can also be achieved by providing a method of manufacturing the contact material as described above including the steps of manufacturing a skeleton with the arc-proof constituent and infiltrating the skeleton with an infiltration material to obtain the contact material. The infiltration material includes the conductive constituent added with the auxiliary constituent.

These and other objects of this invention can further be achieved by providing a method of manufacturing the contact material as described above including the step of mixing powders of the arc-proof constituent, the auxiliary constituent and the conductive constituent to form a mixed contacts material powder. The method further includes the steps of forming the mixed contacts material powder to form a molded body and sintering the molded body to obtain the contacts material.

Specifically, the reason why the adhesion between the arc-proof constituent and the conductive constituent in the contact material is increased by the addition of the auxiliary constituent to the arc-proof constituent and conductive constituent is described below. In the case of the conventional contact material, in which the arc-proof material such as tungsten is employed, insufficient interface strength was obtained owing to its complete failure to form a solid solution with or to react with a conductive constituent such as copper. In the case of the contact material of this invention there is added the auxiliary constituent that reacts with the arc-proof material and also reacts with the conductive constituent. As a result, the arc-proof constituent and conductive constituent are more tightly adhered, so that restriking can be prevented, because a reduction is achieved in discharge from the surface of the arc-proof grains, generation of marked unevenness on occurrence of welding, and pores in the interior of the contacts.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
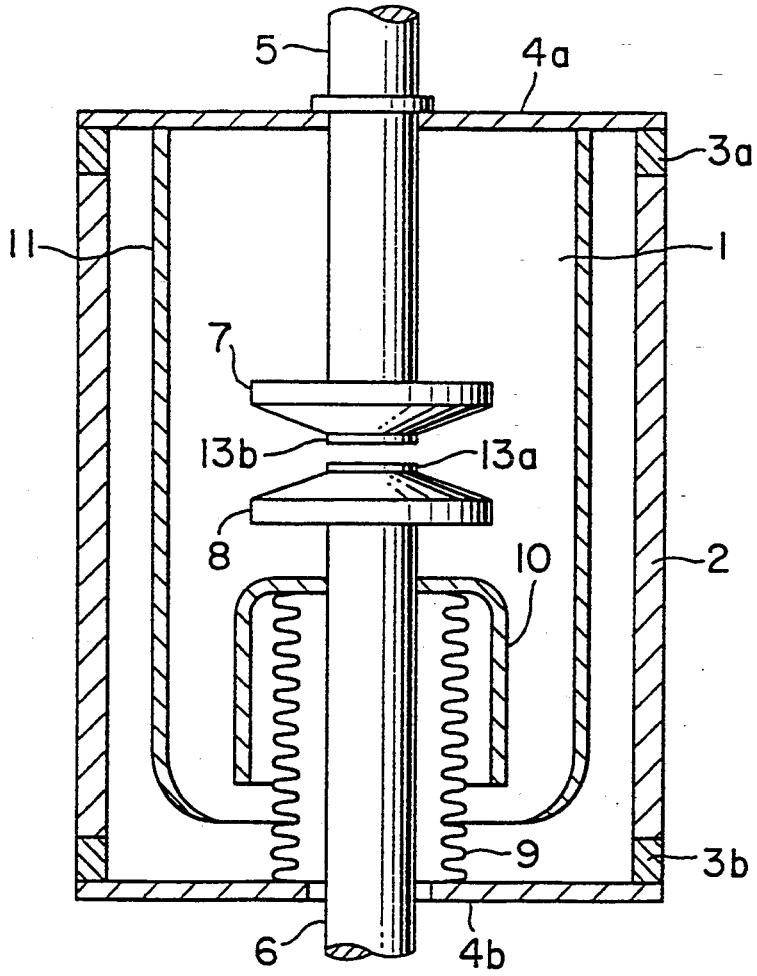
FIG. 1 is a cross-sectional view of a vacuum valve to which a contacts material for the vacuum valve according to this invention is applied.
Figure 2:
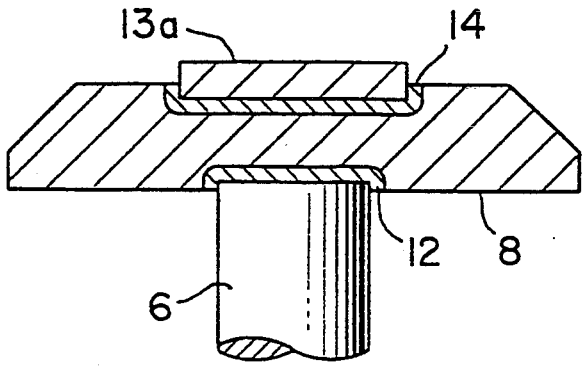
FIG. 2 is an enlarged cross-sectional view of the electrode portion of the electrode portion of the vacuum value shown in FIG. 1.

Embodiments of this invention are described below with reference to the drawings. FIG. 1 is cross-sectional view of a vacuum valve. FIG. 2 is a view to a larger scale of the electrode portion of the vacuum valve shown in FIG. 1.

In FIG. 1, a circuit breaking chamber 1 is constituted by an insulating vessel 2 formed practically on a cylinder by insulating material and metal covers 4*a*, 4*b* provided at both ends thereof, with interposition of sealing fitments 3*a* and 3*b*, the chamber being maintained under vacuum.

The circuit breaking chamber 1 has arranged within it a pair of electrodes 7 and 8 mounted at facing ends of conductive rods 5 and 6. For example upper electrode 7 is the fixed electrode, while lower electrode 8 is the movable electrode. A bellows 9 is fitted to conductive rod 6 of this electrode 8, so that movement in the axial direction of electrode 8 can be performed while maintaining a vacuum-tight environment within circuit breaking chamber 1. A metal arc shield 10 is provided at the top of the bellows 9 to prevent bellows 9 being covered by arc vapour. A metal arc shield 11 is provided in circuit breaking chamber 1 so as to cover electrodes 7 and 8, to prevent insulating vessel 2 being covered by arc vapor.

As shown in FIG. 2, electrode 8 is fixed to conductive rod 6 by a brazing portion 12, or is press-fitted by caulking. A contact 13*a* is mounted on electrode 8 by brazing a portion 14. Essentially the same construction is adopted for electrode 7.

Next, examples of a method of manufacturing contact material according to this invention will be described. Methods of manufacturing contact material can be broadly classified into the infiltration method, wherein the conductive constituent is melted and allowed to flow into a skeleton formed of the arc-proof powder etc., and the sintering method, in which the powders are mixed in prescribed proportions and molded and sintered.

Compared with the prior art methods, the method of manufacture according to this invention has the following characteristics. Specifically, in the case of the infiltration method, the characteristic feature is that a skeleton is manufactured by sintering in for example vacuum atmosphere a mixed powder consisting of the arc-proof powder and the third element powder (auxiliary constituent powder), and the conductive constituent is infiltrated into this skeleton in for example a vacuum atmosphere to manufacture contact material. It is also possible to manufacture the contacts material by infiltrating a conductive constituent, to which the third element has been added, into a skeleton manufactured of arc-proof powder only. In the case of the sintering method, the characteristic feature is that the contact material is manufactured by sintering for example in a vacuum atmosphere a mixed powder consisting of arc-proof powder, conductive powder and a third element powder blended in prescribed amounts. In both the infiltration and sintering methods, the contacts can be manufactured using a composite powder obtained by coating the surface of the arc-proof constituent powder with the third element, or an alloy powder of the arc-proof element and the third element.

Next, a method of evaluation and the conditions for the evaluation will be explained, whereby concrete examples, to be described, are obtained. With the above described matters in view, a comparison was made between contact material according to this invention and conventionally manufactured contact material, in terms of frequency of occurrence of restriking. The disc-shaped sample of contact material of diameter a diameter of 30 mm, and a thickness of 5 mm is fitted in a demountable-type vacuum valve. Then, measurements were carried out by measuring the frequency of occurrence of restriking on breaking a 60 kV×500A circuit 2000 times by the demountable-type vacuum valve. The results were expressed as a percentage occurrence of restriking. For fitting the contact, only baking heating (450° C.×30 minutes) was performed. Brazing material was not used, and the heating which would accompany this was not performed.

[TABLE 1]

| | Chemical constituents (vol %) | | | Percentage occurrence of restriking | Method of manufacture | Notes |
|---|---|---|---|---|---|---|
| | Nb | Cr | Cu | | | |
| Comparative example 1 | 25 | 0 | Bal | 1–2% | sintering | |
| Example 1 | 25 | 1 | Bal | 0.8% | sintering | |
| Example 2 | 25 | 25 | Bal | 0.5% | infiltration | |
| Example 3 | 25 | 50 | Bal | 0.5% | infiltration | |
| Comparative example 2 | 25 | 65 | Bal | 0.8% | infiltration | Large contact resistance |

[TABLE 2]

| | Chemical constituents (vol %) | | | Percentage occurrence of restriking | Method of manufacture | Notes |
|---|---|---|---|---|---|---|
| | Ta | Ti | Cu | | | |
| Comparative example 3 | 15 | 1 | Bal | 0.8% | sintering | insufficient breaking ability |
| Example 4 | 25 | 1 | Bal | 0.8% | sintering | |
| Example 5 | 50 | 1 | Bal | 0.5% | infiltration | |
| Example 6 | 70 | 1 | Bal | 0.5% | infiltration | |
| Comparative example 4 | 90 | 1 | Bal | 0.8% | infiltration | Large contact resistance |

[TABLE 3]

| | Chemical constituents (vol %) | | | | | | | Percentage occurrence of restriking | Method of manufacture |
|---|---|---|---|---|---|---|---|---|---|
| | W | Mo | Y | Zr | Co | Cu | Ag | | |
| Example 7 | 50 | 0 | 0 | 0 | 5 | 30 | 15 | 0.8% | infiltration |
| Example 8 | 25 | 25 | 1 | 1 | 0 | Bal | 0 | 0.5% | infiltration |

[TABLE 4]

| | Chemical constituents (vol %) | Method of manufacture | Percentage of restriking |
|---|---|---|---|
| Example 9 | 45Nb—5Cr—Cu | sintering | 0.5% |
| Example 10 | 45Nb—1Cr—Cu | sintering | 0.5% |
| Example 11 | 20Nb—20Cr—Cu | sintering | 0.5% |
| Example 12 | 25Nb—3Cr—Cu | sintering | 0.8% |

In the manufacture of Table 1 through Table 3, a single metal powder was employed. The skeleton for the infiltration method was manufactured only of arc-proof powder and auxiliary constituent powder. Oxygen-free copper and vacuum-melted Ag/Cu alloy were employed as infiltration material.

Examples 1–3, Comparative Examples 1–2 (refer to Table 1)

Contacts were manufactured with the niobium content of the arc-proof material fixed at 25 volume % but with added amounts of the chromium auxiliary constituent of 0, 1, 25, 50 and 65 volume % (comparative example 1, examples 1, 2 and 3 and comparative example 2, respectively). The raw material powder used consisted of a mixture of niobium powder and chromium powder. Comparative example 1 and example 1 were manufactured by the sintering method. In more detail, manufacture was carried out by sintering at prescribed temperature after mixing and molding niobium powder, chromium powder and copper powder to prepare samples to be tested. The detailed conditions for manufucturing these samples are described as CONDITION 1.

CONDITION 1 for Example 1 and Comparative Example 1

A Nb powder, a Cr powder and a Cu powder having an average grain size of 100, 50 and 30 micrometers, respectively, are provided. These are mixed for 12 hours in a ball mill. The resulting mixture is molded with a molding pressure of 8 metric tons per square centrimeter. The resulting molded body is sintered at a temperature of 1050° C. for 3 hours under a vacuum of $1.0\times10^{-2}$ Pa to obtain the sample of the contact material.

Examples 2 and 3 and comparative example 2 were manufactured by the infiltration method. In more detail, a skeleton was manufactured by mixing, forming and sintering niobium powder and chromium powder. Next, samples were prepared by infiltration of oxygen-free copper into the skeleton. The detailed conditions for manufacturing these samples are described in CONDITION 2.

CONDITION 2 for Examples 2 and 3 and Comparative Example 2

A Nb powder and a Cr powder having an average grain size of 100 and 50 micrometers, respectively, are provided. These are mixed for 12 hours in a ball mill. The resulting mixture is molded with a molding pressure of 0.5, 2 and 5 metric tons per square centimeter, for example 2, example 3 and comparative example 2, respectively. The resulting molded body is sintered at a temperature of 1200° C. for 1 hours under a vacuum of $1.0\times10^{-2}$ Pa to obtain a skeleton. The skeleton is infiltrated by oxygen-free copper at a temperature of 1130° C. for 0.5 hour under a vacuum of $1.0\times10^{-2}$ Pa to obtain the sample of the contact material.

The probability of occurrence of restriking was measured after processing these samples and mounting them in a demountable-type vacuum valve. As shown in Table 1, the result was that, whereas in comparative example 1, in which no chromium was added, the probability of occurrence of restriking was 1–2%, in examples 1, 2, and 3, in which 1, 25 and 50% chromium was added, it was 0.5–0.8%, representing an improvenent. The probability of occurrence of restriking, at 0.8%, was also improved in the case of comparative example 2, in which 65% chromium was added. But this comparative example 2 is problematic in practical use because it has a large contact resistance owing to the dearth of conductive constituent. For purposes of comparison, an attempt was also made to manufacture Nb-Cu contact material by the infiltration method with no chromium addition. However, perhaps infiltration could not be achieved due to the effect of surface oxide.

Examples 4–6, Comparative Examples 3–4 (see Table 2)

Contact materials were manufactured with the addition of the auxiliary constituent titanium fixed at 1 volume % but with contents of the arc-proof constituent tantalum of 15, 25, 50, 70 and 90 volume % (comparative example 3, examples 4, 5 and 6 and comparative example 4, respectively). In the case of comparative example 3 and example 4, the method of manufacturing the contact material was the sintering method. The detailed conditions for manufacturing these samples are described in CONDITION 3.

CONDITION 3 for Example 4 and Comparative Example 3

A Ta powder, a Ti powder and a Cu powder having an average grain size of 100, 50 and 30 micrometers, respectively, are provided. The following process is the same as that of the CONDITION 1.

In the case of examples 5 and 6 and comparative example 4, the infiltration method was employed. The detailed conditions for manufacturing these samples are described in CONDITION 4.

CONDITION 4 for Examples 5 and 6 and Comparative Example 4

A Ta powder and a Ti powder having an average grain size of 100 and 50 micrometers, respectively, are provided. These are mixed for 12 hours in a ball mill. The resulting mixture is molded with a molding pressure of 0.5, 2 and 5 metric tons per square centimeter, for example 5, example 6 and comparative example 4, respectively. The following process is the same as that of CONDITION 2.

In the case of all the samples, an improvement with respect to the restriking probability was seen, this being 0.5–0.8%. However, in the case of comparative example 3, in which the tantalum content was 15%, the circuit-breaking capability was much decreased, and in the case of comparative example 4 in which the tantalum content was 90%, the contact resistance became large as in comparative example 2 referred to above, to the extent that this sample could not be incorporated in a practical vacuum valve.

Examples 7–8 (see Table 3)

In Table 1 examples using Nb - Cr - Cu systems and in Table 2 examples using Ta - Ti - Cu system were described. However, reduction in the restriking probability can likewise be obtained by the use of tungsten and molybdenum as arc-proof material instead of niobium and tantalum, and by the use of yttrium, zirconium, cobalt or vanadium as an auxiliary constituent instead of chromium or titanium. Also silver could be used as conductive constituent instead of copper. Example 7 is an example in which contact consisting of 50 volume % W - 5% Co - 30% Cu - 15% Ag were manufactured by the infiltration method. Example 8 is an example in which contact consisting of 25% W - 25% Mo 1% Y - 1% Zr-Cu (Balance) were manufactured by the infiltration method. The detailed conditions for manufacturing these samples are described in CONDITION 5.

CONDITION 5 for Examples 7 and 8

A W powder, a Co powder, a Cu powder and an Ag powder having an average grain size of 3, 5, 30 and 30 micrometers, respectively, are provided for example 7. A W powder, a Mo powder, a Y powder, a Zr powder and a Cu powder having an average grain size of 3, 3, 30, 30 and 30 micrometers, respectively, are provided for example 8. The following process is the same as that of the example 2 in the CONDITION 2. Both of these contact were useful as they offered low restriking probabilities of 0.8% and 0.5%.

From the results of examination of the above examples it can be seen that the frequency of restriking can be reduced not merely by the compositions of the example but by employing tantalium, niobium, molybdenum or tungsten as arc-proof material, chromium, titanium, yttrium, zirconium, cobalt or vanadium as auxiliary constituent, and copper or silver as conductive constituent.

Examples 9–12 (see Table 4)

Next, the method of manufacture will be examined. Example 9 is an example in which a skeleton was manufactured by blending and mixing niobium powder and chronium poweder in the ratio 9:1 and this was then infiltrated with oxygen-free copper. Example 10 is an example in which a skeleton was manufactured consisting of niobium powder only, and this was then infiltrated with a previously prepared 2% Cr - Cu alloy. Example 11 is an example in which a skeleton was prepared by mixing and sintering Nb/Cr alloy powder with Cu powder and this was then infiltrated with further oxygen-free copper. In example 12, contact were manufactured by coating the surface of niobium powder with chromium and then mixing this with copper powder and molding, followed by sintering.

The detailed conditions for manufacturing these samples are described in CONDITIONs 6, 7, 8 and 9.

CONDITION 6 for Example 9

A Nb powder and Cr powder having an average grain size of 100 and 50 micrometers, respectively, are provided. The Nb powder and the Cr powder are blended in the ratio of 9:1 by volume and then mixed for 12 hours in a ball mill. The resulting mixture is molded with a molding pressure of 0.5 metric tons per square centimeter. The resulting molded body is sintered at a temperature of 1200° C. for 3 hours under a vacuum of $1.0\times10^{-2}$ Pa to obtain a skeleton. The skeleton is infiltrated by oxygen-free copper at a temperature of 1130° C. for 0.5 hour under a vacuum of $1.0\times10^{-2}$ Pa to obtain the sample of the contact material.

CONDITION 7 for Example 10

A Nb powder having an average grain size of 100 micrometers is molded with a molding pressure of 0.5 metric tons per square centimeter. The resulting molded body is sintered at a temperature of 1200° C. for 3 hours under a vacuum of $1.0\times10^{-2}$ Pa to obtain a skeleton. 2% Cr - Cu alloy is prepared by melting Cr and Cu under a vacuum of $1.0\times10^{-2}$ Pa, in advance. The skeleton is infiltrated by 2% Cr - Cu alloy at a temperature of 1130° C. for 0.5 hour under a vacuum of $1.0\times10^{-2}$ Pa to obtain the sample of the contact material.

CONDITION 8 for Example 11

50 wt% Nb - Cr alloy is crushed into an alloyed powder having an average grain size of 100 micrometers. The alloyed powder and a Cu powder having an average grain size of 30 micrometers are mixed for 12 hours in a ball mill. The resulting mixture is molded with a molding pressure of 3 metric tons per square centimeter. The resulting molded body is sintered at a temperature of 1200° C. for 1 hour under a vacuum of $1.0\times1.0^{-2}$ Pa to obtain a skeleton. The skeleton is infiltrated by oxygen-copper at a temperature of 1130° C. for 0.5 hour under a vacuum of $1.0\times10^{-2}$ Pa to obtain the sample of the contact material.

CONDITION 9 for Example 12

A Nb powder having an average grain size of 100 micrometers is coated with Cr to form a composite powder, in which Nb and Cr are in the ratio of 9:1 by volume. The composite powder and a Cu powder having an average grain size of 30 micrometers are mixed for 12 hours in a ball mill. The resulting mixture is molded with a molding pressure of 8 metric tons per square centimeter. The resulting molded body is sintered at a temperature of 1050° C. for 3 hours under a vacuum of $1.0\times10^{-2}$ Pa to obtain the sample of the contact material.

The restriking probabilities of these contact were in each case 0.5–0.8% i.e. good results were obtained.

When the cross-sectional structure of the contact materials manufactured by these various methods was observed using an optical microscope and an electron microscope, it was found that in all cases the periphery of the arc-proof material tended to be surrounded by the auxiliary constituent, confirming that the auxiliary constituent plays the role of bonding the arc-proof material and the conductive constituent. In particular, this trend was very noticeable in contact material manufactured by the infiltration method. It can be inferred that this result is reflected in the fact that, whereas the probability of occurrence of restriking is about 0.8% in the case of contact material manufactured by sintering, that of contact material manufactured by infiltration is 0.5%. When manufacturing contact material by the sintering method, to suppress occurrence of restriking, it is therefore desirable to have the sintering temperature to be as close to the melting point as possible. But contact material even manufactured by the sintering method can also lower the probability of restriking sufficiently.

Also, on subjecting the conductive constituent matrix constructed with conductive constituent to examination of the cross-sectional structure, it was found that in many places the auxiliary constituent had melted or precipitated within the conductive constituent matrix, resulting in firm adhesion between the auxiliary constituent and the conductive constituent. This phenomenon too was found to be particularly noticeable in contact material produced by the infiltration method.

From the results of examination of the above examples, it is clear that, in the method of manufacture according to this invention, similar results can be obtained not just in the present examples but also by partial combinations of these examples.

As described above, with this invention, contact material for a vacuum valve, and a method of manufacturing it, can be obtained which is of high reliability and whereby the probability of restriking is reduced, owing to the increased strength of adhesion between arc-proof constituent and conductive constituent which is obtained thanks to the auxiliary constituent.

Obviously, numerous modifications and variations of the present invention are possible in light of the above teachings. It is therefore to be understood that within the scope of the appended claims, the invention may be practiced otherwise than as specifically described herein.

What is claimed is:

1. A contact material for a vacuum valve, comprising:

an arc-proof constituent comprising at least one component selected from the group consisting of tantalum, niobium, tungsten and molybdenum;

an auxiliary constituent comprising at least one component selected from the group consisting of chromium, titanium, yttrium, zirconium, cobalt and vanadium; and a conductive constituent comprising at least one component selected from the group consisting of copper and silver;

an amount of said arc-proof constituent being from 25% to 75% by volume;

a total amount of said-arc-proof constituent together with said auxiliary constituent being no more than 75% by volume; and an amount of said conductive constituent being the balance.

2. A contact material for a vacuum valve, comprising:

an arc-proof constituent comprising at least one component selected from the group consisting of tantalum, niobium, tungsten and molybdenum;

an auxiliary constituent comprising at least one component selected from the group consisting of chromium, titanium, yttrium, zirconium, cobalt and vanadium; and a conductive constituent comprising at least one component selected from the group consisting of copper and silver;

an amount of said arc-proof constituent being from 25% to 75% by volume;

a total amount of said-arc-proof constituent together with said auxiliary constituent being no more than 75% by volume; and an amount of said conductive constituent being the balance wherein said auxiliary constituent is formed to surround a periphery of said arc-proof constituent; and said conductive constituent is in a form of a conductive constituent matrix.

3. A contact material for a vacuum valve, comprising:

an arc-proof constituent comprising at least one component selected from the group consisting of tantalum, niobium, tungsten and molybdenum;

an auxiliary constituent comprising at least one component selected from the group consisting of chromium, titanium, yttrium, zirconium, cobalt and vanadium; and a conductive constituent comprising at least one component selected from the group consisting of copper and silver;

an amount of said arc-proof constituent being from 25% to 75% by volume;

a total amount of said-arc-proof constituent together with said auxiliary constituent being no more than 75% by volume; and an amount of said conductive constituent being the balance wherein said arc-proof constituent and said auxiliary constituent are formed in an alloy; and said conductive constituent is in a form of a conductive constituent matrix.

4. The contact material for vacuum valve according to claim 2 or 3, wherein:

said auxiliary constituent is melted within said coductive constituent matrix.

5. The contact material for vacuum valve according to claim 2 or 3, wherein:

said auxiliary constituent is precipitated within said conductive constituent matrix.

* * * * *